US010520852B2

(12) United States Patent
Mochizuki et al.

(10) Patent No.: US 10,520,852 B2
(45) Date of Patent: Dec. 31, 2019

(54) IMAGE FORMING APPARATUS

(71) Applicant: CANON KABUSHIKI KAISHA, Tokyo (JP)

(72) Inventors: Masataka Mochizuki, Mishima (JP); Hisashi Yamauchi, Numazu (JP); Norihito Naito, Namazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/129,990

(22) Filed: Sep. 13, 2018

(65) Prior Publication Data

US 2019/0101844 A1 Apr. 4, 2019

(30) Foreign Application Priority Data

Sep. 29, 2017 (JP) ..... 2017-190464

(51) Int. Cl.
*G03G 15/08* (2006.01)
*B05D 1/28* (2006.01)
*G03G 21/00* (2006.01)

(52) U.S. Cl.
CPC ..... *G03G 15/081* (2013.01); *B05D 1/28* (2013.01); *G03G 15/0806* (2013.01); *G03G 15/0812* (2013.01); *G03G 15/0881* (2013.01); *G03G 21/0094* (2013.01)

(58) Field of Classification Search
CPC ..... G03G 15/081; G03G 15/0881; G03G 15/0812; G03G 15/0806; G03G 1/28; G03G 21/0094
See application file for complete search history.

(56) References Cited

U.S. PATENT DOCUMENTS 4,521,847 A * 6/1985 Ziehm ..... G03G 15/5012 399/46
7,003,249 B2 2/2006 Hasegawa et al.
7,444,092 B2 10/2008 Naito et al.
8,472,823 B2 6/2013 Okubo et al.
8,718,499 B2 5/2014 Okubo et al.

FOREIGN PATENT DOCUMENTS

JP 2002-229333 A 8/2002
JP 2002-328569 A 11/2002

* cited by examiner

*Primary Examiner* — Ryan D Walsh
(74) *Attorney, Agent, or Firm* — Venable LLP

(57) ABSTRACT

An image forming apparatus includes an image bearing member on which an electrostatic latent image is formable, and a developing device including a developer carrying member, a container, and a supply roller. When the developing device including the developer carrying member, to which a lubricant different from the developer is applied, is used for the first time, a first initial operation of transferring the lubricant from the developer carrying member to the image bearing member together with the developer is performed. The image forming apparatus further includes a storage unit configured to store a suspension state when suspension is detected before the initial operation completes, and a controller configured to execute a second initial operation as an operation of resuming the suspended first initial operation on the basis of the stored suspension state.

12 Claims, 14 Drawing Sheets

IMAGE FORMING APPARATUS

BACKGROUND OF THE INVENTION

Field of the Invention

The present invention relates to an image forming apparatus such as a copying machine, a printer, or a facsimile.

Description of the Related Art

Conventionally, a developing device is provided in an electrophotographic image forming apparatus such as an electrophotographic copying machine, a laser beam printer, or a facsimile. The developing device is provided with a developing roller, a developer supply roller, and a developer regulating blade. The developing roller is disposed to block an opening of a developer container that stores a developer mainly, and a portion thereof is exposed to the outside of the container to face a photosensitive drum. The developer supply roller supplies a developer to the developing roller. The developer regulating blade abuts on a surface of the developing roller so that the developing roller conveys a constant amount of developer.

A surplus amount of the developer adhering on the surface of the developing roller is removed from the surface of the developing roller when passing between the developing roller and the developer regulating blade with rotation of the developing roller and is returned to the developer container whereby a thin layer of developer is formed on the developing roller. At the same time, a frictional charge (also referred to as a triboelectric charge) is applied to the developer due to friction with the developer regulating blade, the developer is moved from the portion of the developing roller exposed from the developer container onto an electrostatic latent image formed on the surface of the photosensitive drum rotating in a state of facing the exposed portion, and a developer image is formed.

The developer image formed on the photosensitive drum is transferred to a recording medium and is provided to users through a fixing step. In a step of transferring a developer image to the photosensitive drum, some developer remains on the photosensitive member without being transferred to the recording medium, and the remaining developer is removed from the photosensitive drum by a cleaning mechanism disposed on the photosensitive drum. The popular cleaning mechanism is to utilize a blade (a cleaning blade) to abut on the photosensitive drum. After removing a transfer-residual toner from the photosensitive drum, a subsequent image forming process is performed.

Such a developing device is generally delivered from a manufacturer to users in a form of a detachable cartridge. For example, when a developer in the developing device is insufficient and an image cannot be formed, a user purchases a new developing device which is configured to be detachably attached to an image forming apparatus, inserts the developing device into a main body of the image forming apparatus, and uses the developing device. In order to prevent a developer from leaking from a developer container during delivery of a new developing device, a developer storage portion in the developing device is often maintained in a sealing state until the developing device is delivered from a manufacturer to the user.

As described above, a new developing device is in a state in which a developer is not coated on the surface of the developing roller. Therefore, when a new developing device is inserted into an apparatus body and the developing roller is rotated, very large torque is generated between the developing roller and an abutting member such as the developer regulating blade and the developer supply roller. As a result, a serious problem such as destruction of an abutting member and a driving member of the developing device may occur.

Due to this, Japanese Patent Application Publication No. 2002-229333, for example, discloses a method of providing a coating member that applies a powder-shaped coating agent as a lubricant so as to abut on a developer carrying member.

Moreover, this lubricant may be mixed with a developer in an initial stage of using the developer and uniform charging of the developer may be inhibited. As a result, image unevenness may occur. Due to this, as disclosed in Japanese Patent Application Publication No. 2002-328569, a method of causing a lubricant on a developing roller to move onto a photosensitive drum before a developing device performs an initial developing operation to thereby prevent such image unevenness.

As described above, when the lubricant disclosed in Japanese Patent Application Publication No. 2002-229333 is used, it is preferable to perform an initial process of causing the lubricant on the developing roller to move onto the photosensitive drum before the developing device performs an initial developing operation as described in Japanese Patent Application Publication No. 2002-328569.

However, when an initial process is stopped halfway due to a certain problem, the lubricant on the developing roller may not be sufficiently moved onto the photosensitive drum. In this case, when toner charging performance deteriorates due to aging, an initial lubricant remaining on the developer supply roller or the developer container may move onto a recording material together with a toner image during printing. The lubricant adhering on a recording material may appear as a streak image on an image and may appear as a streak-shaped foggy image on a white background on a paper. Due to this, it is preferable that the lubricant initially applied to the developing roller is quickly discharged outside the developer container from the developing roller.

SUMMARY OF THE INVENTION

The present invention has been made in view of the above-described problems, and an object thereof is to provide an image forming apparatus in which a developing roller uses a lubricant and which can suppress image unevenness (streak images) occurring due to a lubricant even when an initial process is not ended normally.

In order to solve the above-described problems, the present invention provides the following configuration. That is, an image forming apparatus according to the present invention includes: an image bearing member on which an electrostatic latent image is formed; and a developing device including a developer carrying member for carrying a developer and developing the electrostatic latent image, a container storing the developer, and a supply roller supplying the developer to the developer carrying member, and when the developing device including the developer carrying member, to which a lubricant different from the developer is applied, is used for the first time, the image forming apparatus performs a first initial operation of transferring the lubricant from the developer carrying member to the image bearing member together with the developer, and moreover the image forming apparatus further includes: a storage unit that stores a suspension state when suspension is detected before the initial operation ends; and a controller that executes a second initial operation as an operation of resuming the suspended first initial operation on the basis of the stored suspension state.

In an image forming apparatus in which a developing roller uses a lubricant, image unevenness (streak images) occurring due to a lubricant can be suppressed even when an initial process is not ended normally.

Further features of the present invention will become apparent from the following description of exemplary embodiments with reference to the attached drawings

DESCRIPTION OF THE EMBODIMENTS

Embodiment 1

A developing device of the present embodiment uses a lubricant and performs an initial installation sequence (an initial process) for causing a lubricant on a developing roller to move onto a photosensitive drum before an initial developing operation is performed so as to prevent image unevenness. In the present embodiment, when the initial installation sequence is not completed normally, a mode for changing a lubricant discharge amount is provided as another sequence mode.

Hereinafter, an electrophotographic process cartridge and an electrophotographic image forming apparatus according to the present embodiment will be described as an example.

(Overall Configuration)

Figure 2:
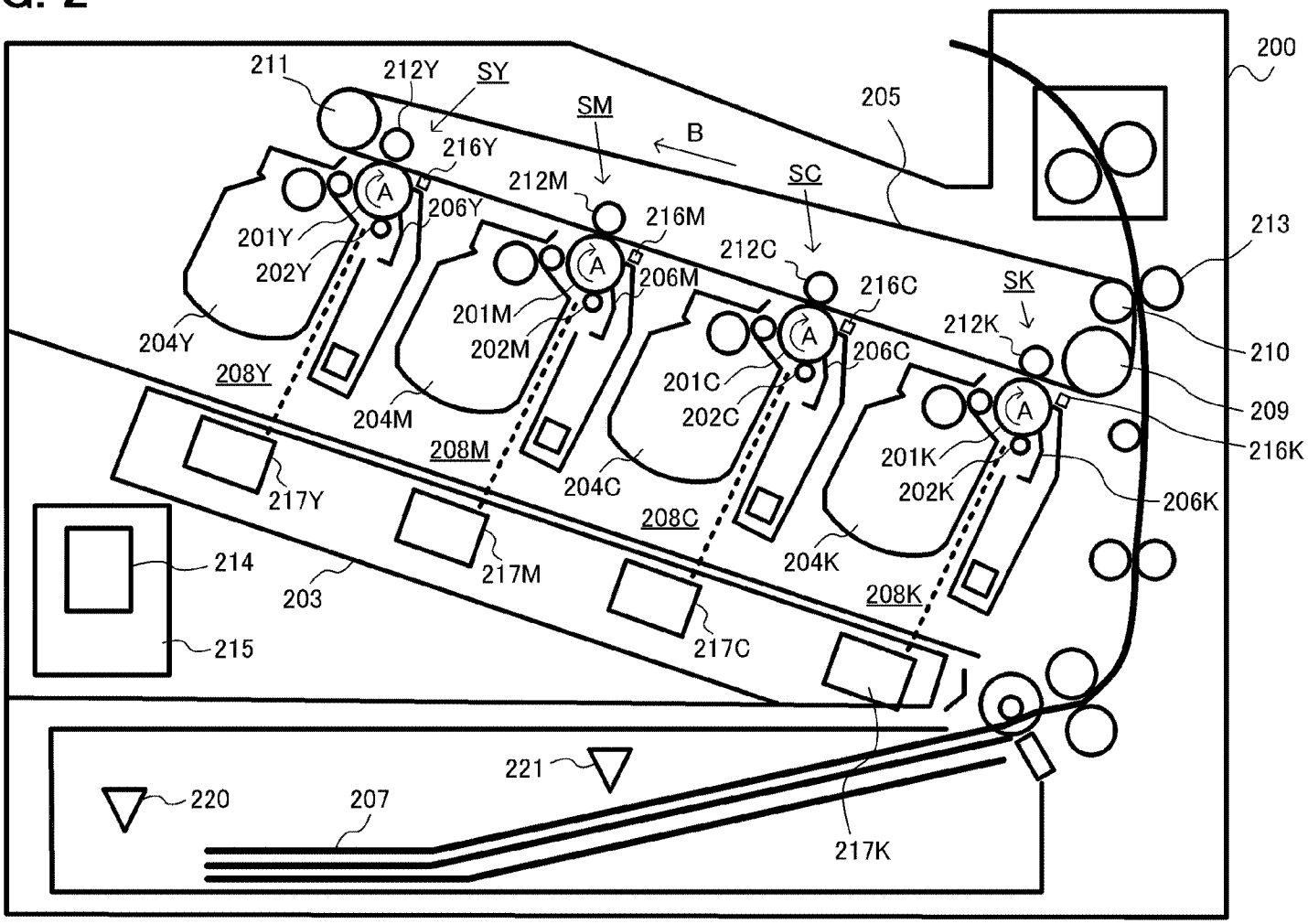
FIG. 2 is a schematic diagram of the image forming apparatus according to an embodiment.

FIG. 2 is a schematic cross-sectional view of an image forming apparatus 200 of the present embodiment. The image forming apparatus 200 of the present embodiment is a full-color laser printer which employs an in-line scheme and an intermediate transfer scheme. The image forming apparatus 200 can form a full-color image on a recording material (for example, a recording sheet) according to image information. The image information is input from an image reader or a host apparatus (such as a personal computer) connected to the image forming apparatus 200 to a CPU 214 provided in an engine controller (a controller) 215 in the image forming apparatus 200.

The image forming apparatus 200 includes first, second, third, and fourth image forming stations SY, SM, SC, and SK for forming images of the colors of yellow (Y), magenta (M), cyan (C), and black (K), respectively. Each image forming station corresponds to an image forming unit. Here, an image forming station includes a process cartridge 208 and a primary transfer roller 212 disposed to face the process cartridge 208 with an intermediate transfer belt 205 disposed therebetween. In the present embodiment, the first to fourth image forming units SY, SM, SC, and SK are disposed in a line in a direction crossing a vertical direction.

In the present embodiment, the first to fourth image forming stations have substantially the same structure and operation except that the image forming stations form images of different colors. Therefore, the letters Y, M, C, and K attached to reference numerals in order to indicate the color of the component will be omitted unless it is necessary to distinguish the respective components particularly, and the image forming stations will be described collectively.

The image forming apparatus 200 includes four drum-shaped electrophotographic photosensitive members (that is, photosensitive drums 201) arranged in parallel in a direction crossing a vertical direction. Each photosensitive drum 201 corresponds to an image bearing member. The photosensitive drum 201 is rotated by a driving source (a driver) (not illustrated) in the direction (the clockwise direction) indicated by arrow A. A charging roller 202 that uniformly charges the surface of the photosensitive drum 201 and a scanner unit (an exposure apparatus) 217 that radiates a laser beam on the basis of image information to form an electrostatic image (an electrostatic latent image) on the photosensitive drum 201 are disposed around the photosensitive drum 201. The charging roller 202 corresponds to a charger and the scanner unit 217 corresponds to an exposing mechanism.

A developing unit (a developing device) 204, a cleaning blade 206, and a pre-exposure LED 216 are disposed around the photosensitive drum 201. The developing unit 204 is configured to develop an electrostatic image as a toner image. The cleaning blade 206 is configured to remove toner (transfer-residual toner) remaining on the surface of the photosensitive drum 201 after transferring. The pre-exposure LED 216 is configured to remove charge on the photosensitive drum 201. Moreover, an intermediate transfer belt 205 for transferring a toner image on the photosensitive drum 201 to the recording material 207 is disposed to face the four photosensitive drums 201. The developing unit 204 corresponds to a developing mechanism, the cleaning blade 206 corresponds to a cleaning member, the pre-exposure LED 216 corresponds to an exposure mechanism, and the intermediate transfer belt 205 corresponds to an intermediate transfer member.

The process cartridge 208 includes a photosensitive drum 201, a charging roller (a charge process mechanism) 202, a developing unit 204, and a cleaning blade 206 which are integrated with each other. The process cartridge 208 is detachably attached to the image forming apparatus 100. In the present embodiment, the process cartridges 208 for the respective colors have the same shape, and toner of the colors of yellow (Y), magenta (M), cyan (C), and black (K) is stored in the process cartridges 208 for the respective colors.

The intermediate transfer belt 205 is formed as an endless belt, and rotates in the direction (the counter-clockwise direction) indicated by arrow B while abutting on all photosensitive drums 201. The intermediate transfer belt 205 is stretched across a plurality of supporting members—specifically, a driving roller 209, a secondary transfer counter roller 210, and a driven roller 211. Four primary transfer rollers (primary transfer mechanisms) 212 are provided in parallel on the inner circumferential surface of the intermediate transfer belt 205 so as to face the respective photosensitive drums 201. A bias of the opposite polarity from a normal charging polarity of toner is applied from a primary transfer bias source (not illustrated) to the primary transfer roller 212. In this way, the toner image on the photosensitive drum 201 is transferred to the intermediate transfer belt 205. Moreover, a secondary transfer roller (a secondary transfer mechanism) 213 is disposed on the outer circumferential surface of the intermediate transfer belt 205 at a position facing the secondary transfer counter roller 210. A bias of the opposite polarity from the normal charging polarity of toner is applied from a secondary transfer bias source (not illustrated) to the secondary transfer roller 213. In this way, the toner image on the intermediate transfer belt 205 is transferred to the recording material 207. A sensor 220 detects a width in a sub-scanning direction of the recording material 207. A sensor 221 detects a width in a main scanning direction of the recording material 207.

Figure 12:
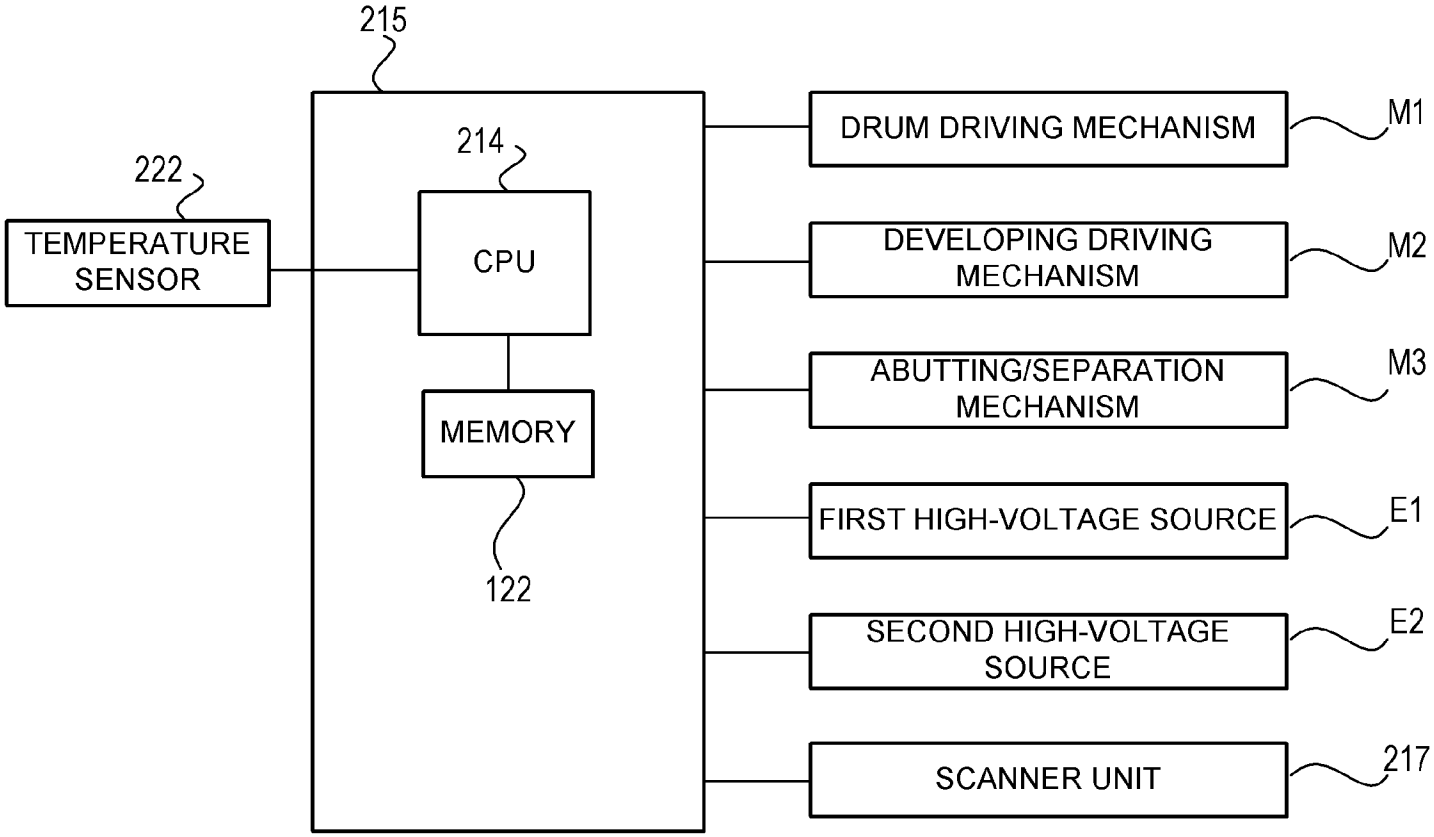
FIG. 12 is a block diagram of a control system of an image forming apparatus.

FIG. 12 illustrates a block diagram of a control system of the image forming apparatus 200. The details of the engine controller (a controller) 215 are illustrated. The controller 215 includes the CPU 214 which is a key device that performs an arithmetic process, a memory 122 such as a ROM and a RAM which are storage devices, and the like. Detection results of various sensors, arithmetic processing results, and the like are stored in the RAM, and a control program, predetermined data tables, and the like are stored in the ROM. The controller 215 is configured to control the operation of the image forming apparatus 200 in an integral manner. The controller 215 is configured to control exchange of various electrical information signals, the driving timings, and the like and is responsible for an initial sequence or the like to be described later.

Various control targets of the image forming apparatus 200 are connected to the controller 215. For example, the controller 215 is connected to a drum driving mechanism M1 for driving a photosensitive drum 1, a developing driving mechanism M2 for driving a developing roller 302, a toner supply roller 304, and a toner conveying member 307, an abutting/separation mechanism M3 for realizing abutting/separation between the photosensitive drum 201 and the developing roller 302, and the like. The drum driving mechanism M1 includes a motor as a driving source for rotating the photosensitive drum 201, and one or more gears for transmitting power from the motor to the photosensitive drum 201. Moreover, the developing driving mechanism M2 includes a motor as a driving source for rotating the developing roller 302 and one or more gears for transmitting power from the motor to the developing roller 302. The abutting/separation mechanism M3 includes a motor, a gear, and the like for switching the position of the developing roller 4 between a position at which the developing roller 4 abuts on the photosensitive drum 201 and a position at which the developing roller 4 is separated from the photosensitive drum 201. The controller 215 is further connected to a first high-voltage source E1 that applies a bias to the charging roller 202, a second high-voltage source E2 that applies a bias to the developing roller 302, the scanner unit (an exposure mechanism) 217, and the like. The initial sequence control by this controller 215 will be described in detail later.

In the present embodiment, a temperature sensor 222 for detecting an ambient temperature is provided in the apparatus body as an environmental sensor for detecting and acquiring information on the installation environment of the image forming apparatus 200 and is connected to the controller 215.

(Configuration of Process Cartridge 208)

Figure 3:
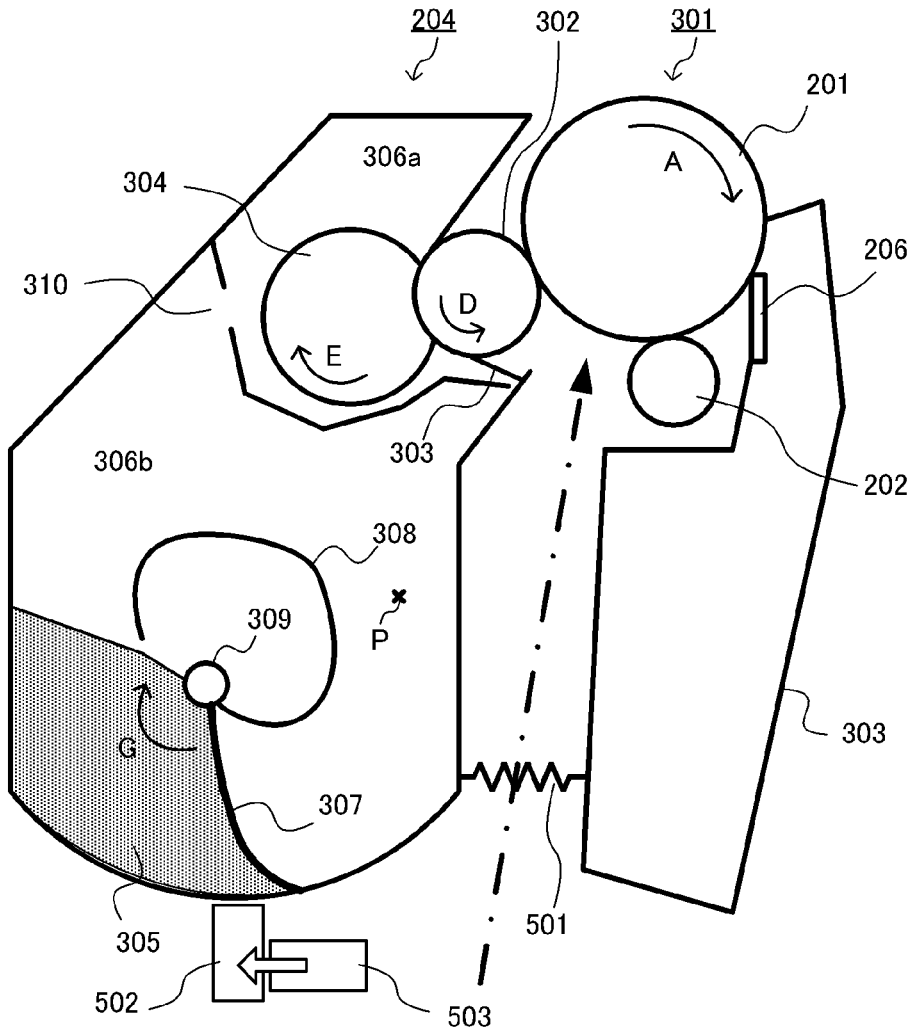
FIG. 3 is a schematic diagram of a process cartridge according to an embodiment.

An entire configuration of the process cartridge 208 attached to the image forming apparatus 200 of the present embodiment is illustrated in FIG. 3. FIG. 3 is a schematic cross-sectional view of the process cartridge 208 of the present embodiment seen from the longitudinal direction (a rotational axis direction) of the photosensitive drum 201. In the present embodiment, the process cartridges 208 of the respective colors have the same structure and operation except that the types (colors) of developer stored therein are different. The process cartridge 208 includes a photosensitive member unit 301 including the photosensitive drum 201 and the like and a developing unit 204 including the developing roller 302 and the like.

The photosensitive member unit 301 includes a cleaning frame 303. The cleaning frame 303 supports various components in the photosensitive member unit 301. The photosensitive drum 201 is rotatably attached to the cleaning frame 303 with a bearing (not illustrated) disposed therebetween. The photosensitive drum 201 rotates in the direction (the clockwise direction) indicated by arrow A according to an image forming operation when the driving force of a driving motor (a driving source) (not illustrated) is transmitted to the photosensitive member unit 301. The photosensitive drum 201 which is a key component of an image forming process is formed using an organic photosensitive member obtained by coating an outer circumferential surface of an aluminum cylinder with an undercoat layer which is a functional film, a carrier generation layer, and a carrier transport layer in that order. Moreover, the cleaning member 206 and the charging roller 202 are disposed in the photosensitive member unit 301 so as to make contact with the circumferential surface of the photosensitive drum 201. The transfer-residual toner removed from the surface of the photosensitive drum 201 by the cleaning member 206 falls and is stored in the cleaning frame 303.

The charging roller 202 is rotated when a roller portion formed of conductive rubber comes into pressure-contact with the photosensitive drum 201. Here, a predetermined DC voltage is applied to the core of the charging roller 202 whereby a uniform dark-part potential (Vd) is formed on the surface of the photosensitive drum 201. A spot pattern of a laser beam emitted from the scanner unit 203 is exposed to the photosensitive drum 201 according to image data, and the charge on the surface of the exposed portion is removed by a carrier from the carrier generation layer whereby the potential decreases. As a result, an electrostatic latent image in which the exposed portion is at a predetermined bright-part potential (Vl) and a non-exposed portion is at a predetermined dark-part potential (Vd) is formed on the photosensitive drum 201.

The developing unit 204 includes the developing roller 302, a developing blade 303, the toner supply roller 304 (hereinafter, a supply roller), a toner 305, a toner storage chamber **306*b* that stores the toner 305, and a developing chamber 306*a***.

The toner storage chamber (a developer storage container) **306*b* is disposed below the developing chamber 306*a* and stores the toner 305 therein. In the present embodiment, the toner 305 is a negative-charging toner. However, the toner used in the present embodiment is not limited to the negative-charging toner. A toner conveying member 307 for conveying the toner 305 toward the developing chamber 306***a* is provided in the toner storage chamber 306*b*. When the toner conveying member 307 rotates in the direction indicated by arrow G in response to the driving force of a driving motor (a developing driving mechanism) (not illustrated) whereby the toner passes through a developing opening 310 and is conveyed to the developing chamber 306*a*.

The developing roller (a developer carrying member) 302 is provided in the developing chamber 306*a*. The developing roller 302 makes contact with the photosensitive drum 201 and rotates in the direction indicated by arrow D in response to the driving force of a driving motor (a developing driving mechanism) (not illustrated). In the present embodiment, the developing roller 302 and the photosensitive drum 201 rotate so that the mutual surfaces of the facing portions (contacting portions) move in the same direction. Moreover, a bias sufficient for developing and visualizing the electrostatic latent image on the photosensitive drum 201 as a toner image is applied from the second high-voltage source E2 as a developing bias source (a developing bias application mechanism) to the developing roller 302. The toner supply roller (hereinafter, a supply roller) 304 and a toner amount regulating member (hereinafter, a regulating member) 303 are disposed in the developing chamber 306*a*. The supply roller 304 supplies the toner 305 conveyed from the toner storage chamber 306*b* to the developing roller 302. The regulating member 303 regulates a coating amount of the toner 305 on the developing roller 302 supplied by the supply roller 304 and applies charge. The supply roller 304 rotates in the direction indicated by arrow E in response to the driving force of a driving motor.

The toner 305 is developed on the electrostatic latent image on the photosensitive drum 201 by the bright-part potential (V1) formed on the photosensitive drum 201 and the second high-voltage source E2 (see FIG. 12) as a predetermined developing bias source applied to the developing roller 302. For a high-print pattern such as solid black, an electrostatic latent image sufficient for the charge amount of the toner 305 formed on the developing roller 302 is formed, and all components of the toner 305 coated on the developing roller 302 are moved to the photosensitive drum 201.

The image forming apparatus 200 according to the present embodiment is configured so that the photosensitive drum 201 and the developing roller 302 take an abutting state in which both members abut each other and a separation state in which both members are separated from each other with the aid of the abutting/separation mechanism M3. As illustrated in FIG. 3, the process cartridge 208 of the present embodiment is configured such that the developing unit 204 is pivotable about a pivotal center P with respect to the photosensitive member unit 301 fixed to the apparatus body in a state in which the process cartridge 208 is attached to the apparatus body of the image forming apparatus 200. Here, the apparatus body is a constituent part of the image forming apparatus 200 excluding the process cartridge 208. The pivotal center P is an axial line extending in the direction vertical to the sheet surface of FIG. 3. A spring 501 as a biasing mechanism which is a part of the abutting/separation mechanism M3 is connected between the developing unit 204 and the photosensitive member unit 301. The spring 501 is assembled such that such a biasing force that the attitude of the developing unit 204 in relation to the photosensitive member unit 301 is such that the developing roller 302 is separated from the photosensitive drum 201 with respect to the photosensitive member unit 301 is generated between the developing unit 204 and the photosensitive member unit 301. Therefore, in a state in which an external force other than the biasing force of the spring 501 is not applied to the developing unit 204, the developing unit 204 and the photosensitive member unit 301 are maintained in a relative state in which the developing roller 302 is separated from the photosensitive drum 201.

As illustrated in FIG. 3, the developing unit 204 includes a pressing target portion 502 as a portion of the abutting/separation mechanism M3 disposed below the frame, and is configured to be pressed against a pressing portion 503 as a portion of the abutting/separation mechanism M3 provided in the apparatus body. When the pressing target portion 502 is pressed against the pressing portion 503, the developing unit 204 pivots about the pivotal center P while resisting against the biasing force of the spring 501 and enters into an attitude (an abutting state) at which the developing roller 302 and the photosensitive drum 201 abut each other. This abutting state is maintained while at least an image forming operation is being performed. When the pressing of the pressing target portion 502 by the pressing portion 503 is released, the developing unit 204 pivots about the pivotal center P according to the biasing force of the spring 501 and enters into an attitude (a separation state) at which the developing roller 302 is separated from the photosensitive drum 201. The separation state is maintained when it is not necessary to cause the developing roller 302 to abut on the photosensitive drum 201 (for example, when the process cartridge 208 is detached or attached, the developing unit 204 and the photosensitive member unit 301 are individually detached or attached, or when the image forming apparatus is in a standby state without performing an image forming operation).

(Toner Seal)

Figure 4:
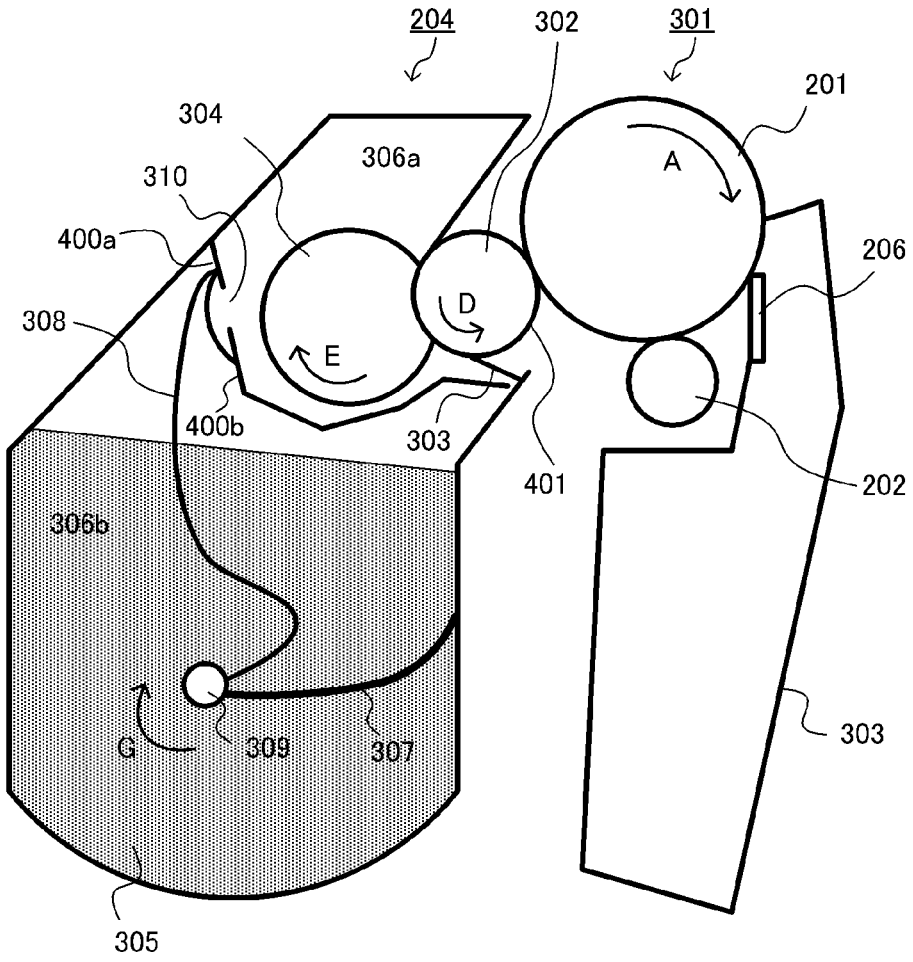
FIG. 4 is an explanatory diagram of a seal of the process cartridge according to an embodiment.

FIG. 4 illustrates a toner seal structure of the process cartridge 208 attached to the image forming apparatus 200 of the present embodiment. Due to the toner seal structure, the toner 305 is prevented from leaking from the developing unit 204 during shipping of the process cartridge 208. FIG. 4 illustrates a toner seal structure during shipping of the process cartridge 208. As illustrated in FIG. 4, the toner 305 is stored in the toner storage chamber 306*b* during shipping. The developing opening 310 is sealed by welding one end of a seal member (a sealing member) 308 to a seal seating surface 400*a* corresponding to an upper part of the developing opening 310 and a seal seating surface 400*b* corresponding to a lower part thereof. With this configuration, entering of toner from the toner storage chamber 306*b* into the developing chamber 306*a* is prevented.

Next, automatic seal removal of the seal member 308 will be described. As illustrated in FIG. 4, an end of the seal member 308 opposite the end that seals the developing opening 310 is glued to a rotating shaft 309 of the toner conveying member 307 at the same position as the gluing position of the toner conveying member 307. With this configuration, the seal member 308 is pulled toward the rotating shaft 309 by being wound around the rotating shaft 309 when the toner conveying member 307 rotates. When the seal member 308 is pulled, the seal member 308 welded to the seal seating surface 400*a* is separated first and the seal member 308 welded to the seal seating surface 400*b* is also separated subsequently, whereby the developing opening 310 is open.

(Lubricant)

Next, the lubricant 401 applied to the developing roller 302 of the present embodiment will be described. In the present embodiment, in a new product state, the toner 305 is not coated on the surface of the developing roller 302, and a lubricant 401 for preventing increase in torque is applied to the surface of the developing roller 302. In the present embodiment, 50 mg of silicone resin particles (product name: Tospearl 120, a product of GE Toshiba Silicones Corporation) is applied as the lubricant 401. A coating width in the longitudinal direction of the developing roller 302 is set such as to cover a position where the developing blade 303 abuts on the developing roller 302. The silicone resin particles are spherical particles having an average grain size of 2 μm and the normal charging polarity is negative similarly to the toner. The grain size is selected by taking the coating amount stability on the developing roller 302. However, the toner used in the present invention is not limited to the negative-charging toner.

(Initial Installation Sequence)

Below described is an initial process cartridge installation sequence (hereinafter, an initial installation sequence) activated when a new process cartridge 208 of the present embodiment is first used after being inserted into the image forming apparatus 200. The object of performing the initial installation sequence is to remove the lubricant 401 coated on the developing roller 302 from the developing roller 302. If there remains a large amount of lubricant 401 on the developing roller 302 when the toner 305 is conveyed from the toner storage chamber 306*b* and is coated on the developing roller 302, the toner 305 mixes with a large amount of lubricant 401 and image unevenness may occur. Moreover, if the toner charging performance deteriorates, which may occur in the latter half of a product's service life, the lubricant 401 may appear as a streak image on an image and may appear as a streak-shaped foggy image on a white background on a paper. The initial installation sequence removes the lubricant 401 from the developing roller 302, thereby suppressing such deterioration in image quality.

The process cartridge 208 is equipped with a nonvolatile memory (not illustrated), and the information stored in the memory indicates whether the inserted process cartridge 208 is a new product or is not used yet.

Figure 5:
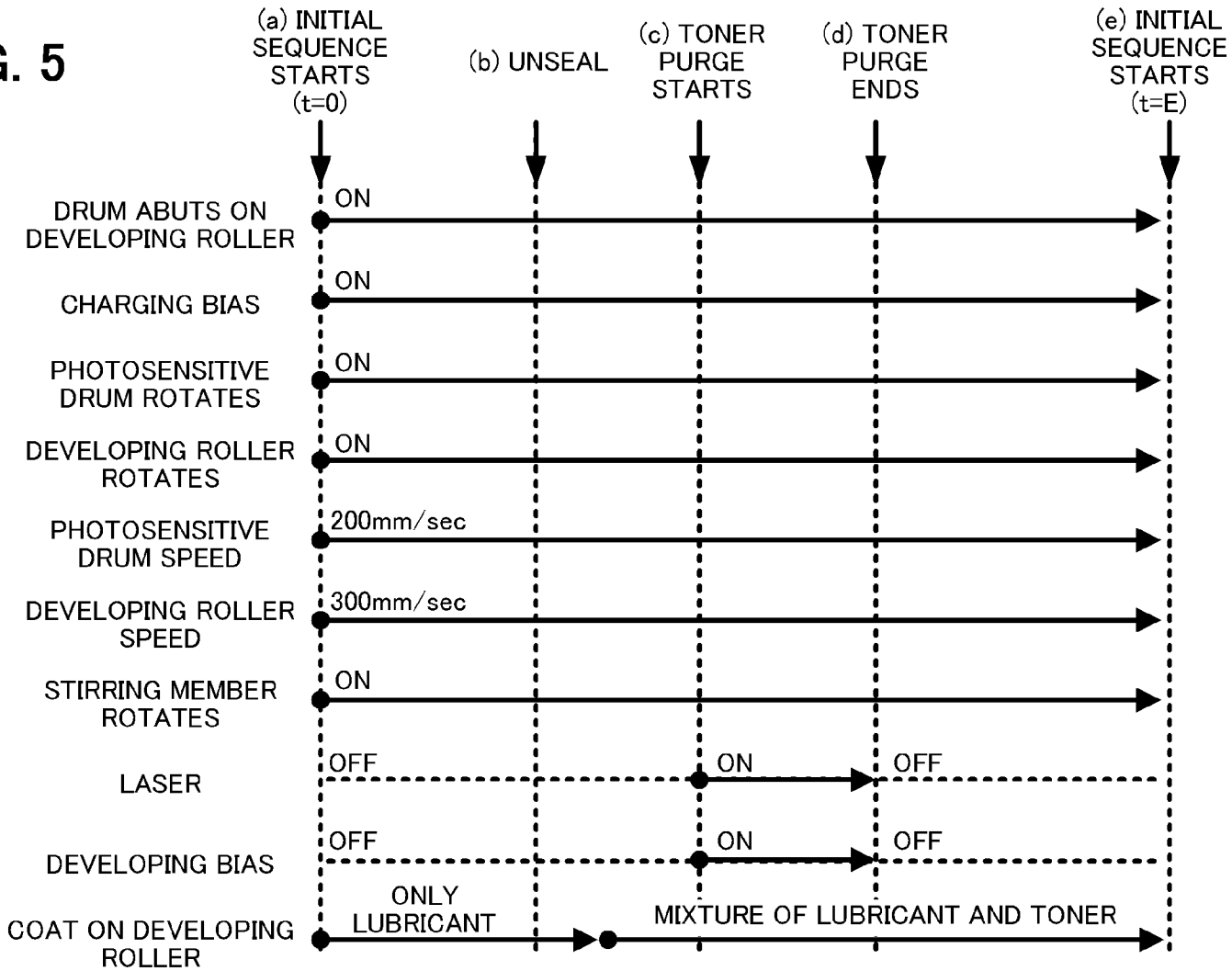
FIG. 5 is a sequence diagram of an initial installation sequence according to an embodiment.

FIG. 5 is a time chart of the initial installation sequence. FIG. 5 illustrates the states of constituent members associated with the initial installation sequence are illustrated in a time-series order. The starting time of the initial sequence is t=0 and the ending time is t=E.

(a) When the initial installation sequence starts, the CPU 214 operates the abutting/separation mechanism M3 to put the photosensitive drum 201 and the developing roller 302 into an abutting state. Substantially simultaneously with this, the CPU 214 applies a charging bias from the first high-voltage source E1 to the charging roller 202. The applied bias is −1000 V, and the surface of the photosensitive drum 201 is charged to −500 V. Substantially simultaneously with this, the CPU 214 operates the drum driving mechanism M1 and the developing driving mechanism M2 to start rotation of the photosensitive drum 201, the developing roller 302, and the toner conveying member 307. In this case, the rotation speed of the photosensitive drum 201 and the developing roller 302 is ½ of the rotation speed in the normal printing operation. This decrease in the rotation speed contributes to suppressing the amounts of the lubricant 401 and the toner 305 supplied at a time. Moreover, laser emission by the scanner unit and a charging bias are turned off. In the present embodiment, the circumferential speed of the photosensitive drum 201 in the initial installation sequence is 200 mm/sec and the circumferential speed of the developing roller 302 is 300 mm/sec. In this case, only the lubricant 401 is present on the surface of the developing roller 302, and the photosensitive drum 201 and the developing roller 302 rotate at different circumferential speed in an abutting state, whereby a portion of the lubricant 401 on the developing roller 302 moves toward the photosensitive drum 201. Another portion of the lubricant 401 on the developing roller 302 moves toward the supply roller 304. The lubricant 401 having moved toward the photosensitive drum 201 is sequentially removed from the surface of the photosensitive drum 201 by the cleaning member 206. The surface of the photosensitive drum 201 from which the lubricant 401 is removed abuts again on the developing roller 302, and the lubricant 401 moves from the developing roller 302 toward the photosensitive drum 201. This is repeated whereby a large part of the lubricant 401 coated on the developing roller 302 is removed from the developing roller 302.

(b) The toner conveying member 307 rotates whereby the seal member 308 is separated and the opening 310 is open. When the toner conveying member 307 rotates further, the toner 305 is conveyed to the developing chamber 306*a*, the supply roller 304 supplies the toner 305 to the developing roller 302, and the surface of the developing roller 302 is coated with the toner 305. Since the above-described operations are performed sequentially, although the rotation start time of the toner conveying member 307 is substantially the same as the start time of the initial installation sequence, a time lag occurs until the toner 305 is coated on the developing roller 302. Due to this, in this period, since the toner 305 is not present on the surface of the developing roller 302 but only the lubricant 401 is present, the lubricant 401 on the developing roller 302 can be efficiently moved toward the photosensitive drum 201. However, the entire portion of the lubricant 401 on the developing roller 302 is not removed but a portion thereof remains. Moreover, the lubricant 401 remains on other portions of the developing roller 302 (for example, the photosensitive drum 201 (particularly, an abutting edge portion 700) and the supply roller 304).

(c) A toner purge process starts. The toner purge process is an operation of forcibly discharging (consuming) the toner 305 from the developing roller 302 and is an operation which does not form an image on the recording material 207 while the toner 305 is consumed. The object of the toner purge process is to remove the lubricant 401 which has not been removed. In the toner purge process, the toner 305 is supplied toward the abutting edge portion 700 (see FIG. 6) between the cleaning member 206 and the photosensitive drum 201 so that the lubricant 401 accumulated near the abutting edge portion 700 is removed from the vicinity of the abutting edge portion 700. In the toner purge process, the accumulated lubricant 401 remaining in the supply roller 304 is discharged to the photosensitive drum 201 via the developing roller 302 simultaneously with the toner 305. The toner purge process is performed by the scanner unit 217 radiating a laser beam on the photosensitive drum 201 to form a solid black electrostatic latent image and applying a developing bias of −300 V from the second high-voltage source E2 to the developing roller 302. The surface potential of the photosensitive drum 201 when a solid black electrostatic latent image is formed is −100 V. The toner of the present embodiment is the negative-charging toner 305. Due to this, when a developing bias is applied, the image of the toner 305 is developed from the developing roller 302 to the photosensitive drum 201, and the toner 305 is conveyed to the vicinity of the abutting edge portion 700 between the cleaning member 206 and the photosensitive drum 201. The lubricant 401 accumulated in the abutting edge portion 700 is removed by being replaced with the toner 305.

Figure 6:
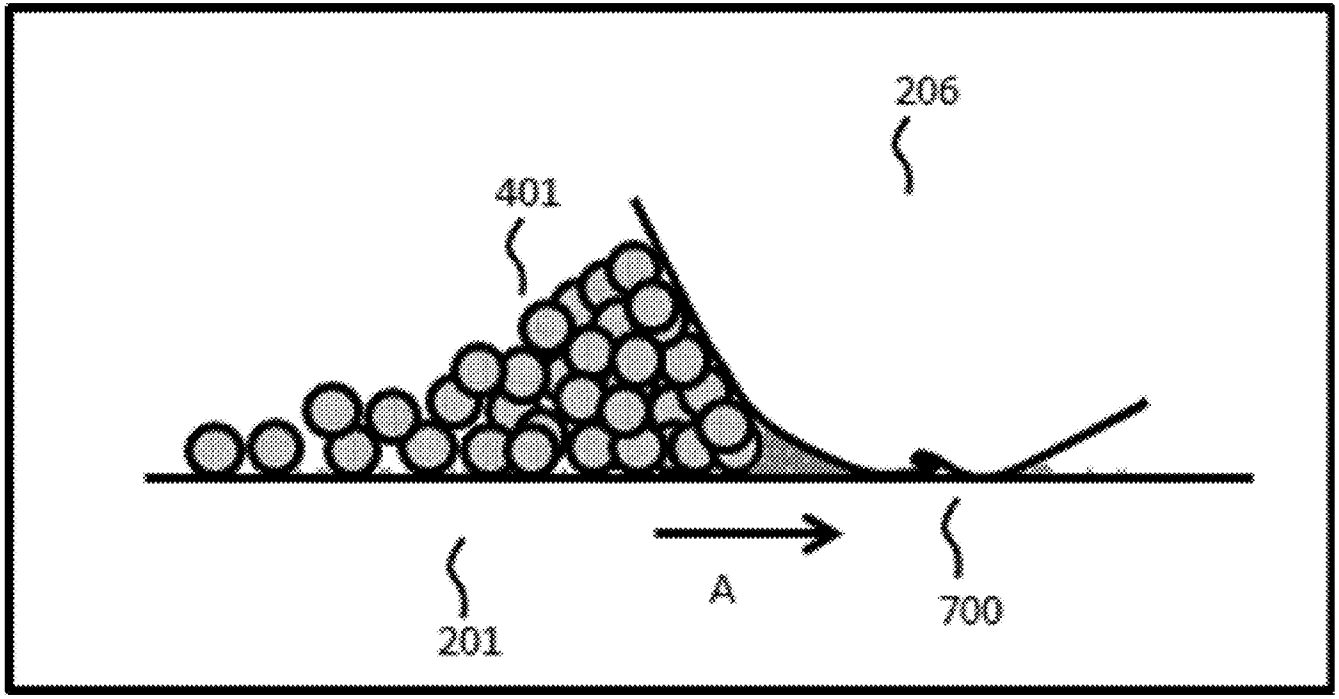
FIG. 6 is an explanatory diagram of an abutting state of a cleaning member and a photosensitive drum according to an embodiment.

As illustrated in FIG. 6, the abutting edge portion 700 is rolled in the rotation direction A of the photosensitive drum 201. Since the lubricant 401 has a smaller grain size than the toner 305, when the lubricant 401 is present near the abutting edge portion 700, the lubricant 401 easily enters between the abutting edge portion 700 and the photosensitive drum 201. Due to this, the lubricant 401 itself may easily slip through the cleaning member 206 and may raise the cleaning member 206 when slipping therethrough, and the toner 305 may slip through the cleaning member 206 simultaneously with the lubricant 401. That is, in a state in which only the lubricant 401 is present near the abutting edge portion 700 between the abutting edge portion 700 and the photosensitive drum 201 of the cleaning member 206, when a large amount of toner 305 is conveyed at a time, the toner 305 may slip through the cleaning member 206. Therefore, in the present embodiment, the amount of the lubricant 401 and the toner 305 conveyed at a time is controlled to 0.0188 mg/cm$^2$.

(d) The toner purge process finishes. Specifically, radiation of a laser beam to the photosensitive drum 201 and application of the developing bias applied to the developing roller 302 are stopped.

(e) The initial sequence completes and the image forming apparatus 200 enters into a printable state.

Figure 7:
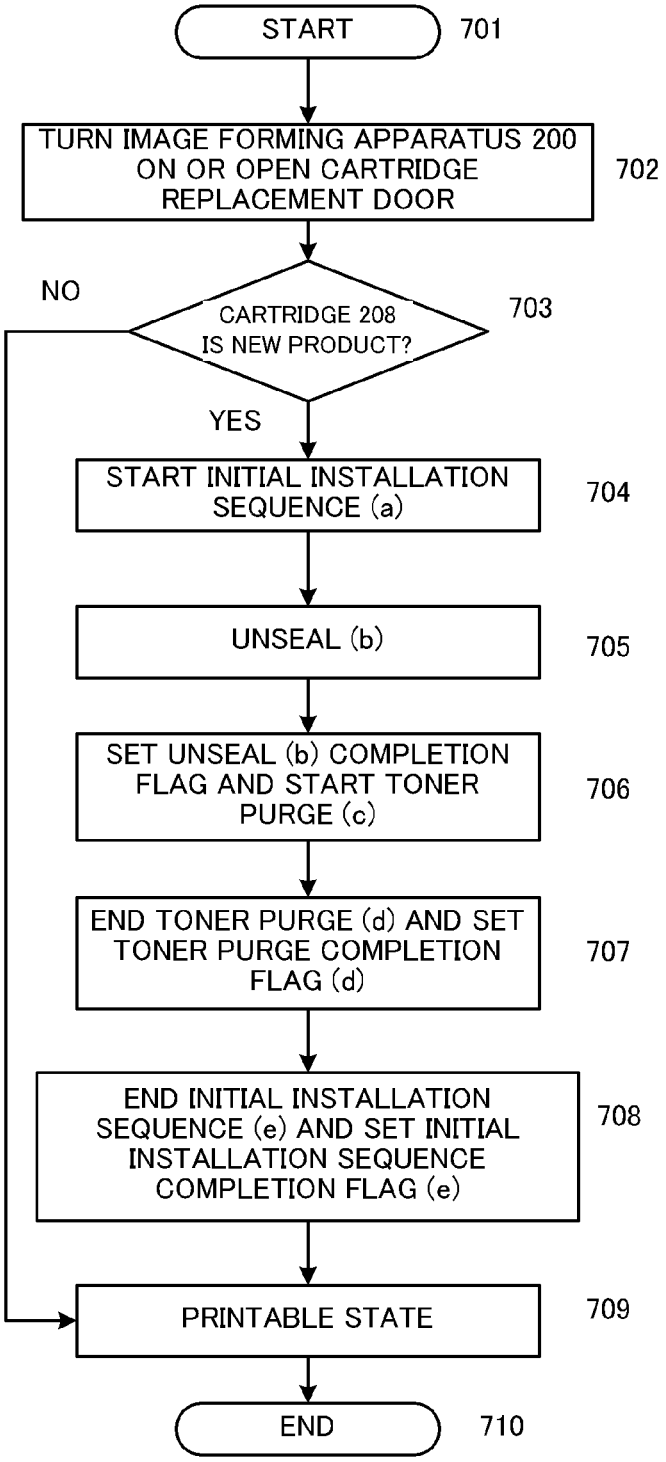
FIG. 7 is a flowchart of an initial installation sequence (without suspension) according to an embodiment.

FIG. 7 illustrates a flowchart of the initial installation sequence of the image forming apparatus 200. The flowchart illustrated in FIG. 7 does not take suspension of the initial installation sequence into consideration. As illustrated in FIG. 7, immediately after the user turns on the power of the image forming apparatus 200 or immediately after the user opens or closes a cartridge replacement door (not illustrated) of the image forming apparatus 200 (702), the CPU 214 determines whether the process cartridge 208 is a new product (703). As described above, this determination is performed on the basis of the information stored in the nonvolatile memory in the process cartridge 208. When the process cartridge 208 is a new product (703: YES), the CPU 214 starts the initial installation sequence (a) (704). When the initial installation sequence (a) starts, the unsealing (b) starts (705). When the unsealing (b) ends, an unseal completion flag is set in a data storage portion in the CPU 214 (706). The toner purge process (c) which is the next initial installation sequence starts (706). When the toner purge process (d) ends, a toner purge completion flag is set in the data storage portion in the CPU 214 (707). After that, the initial sequence (e) ends and an initial sequence completion flag is set in the data storage portion in the CPU 214 (708), and the image forming apparatus 200 enters into a printable state (709).

When it is determined that the process cartridge 208 is not a new product (703: NO), the operation ends by immediately putting the image forming apparatus 200 into a printable state (709).

Figure 8A:
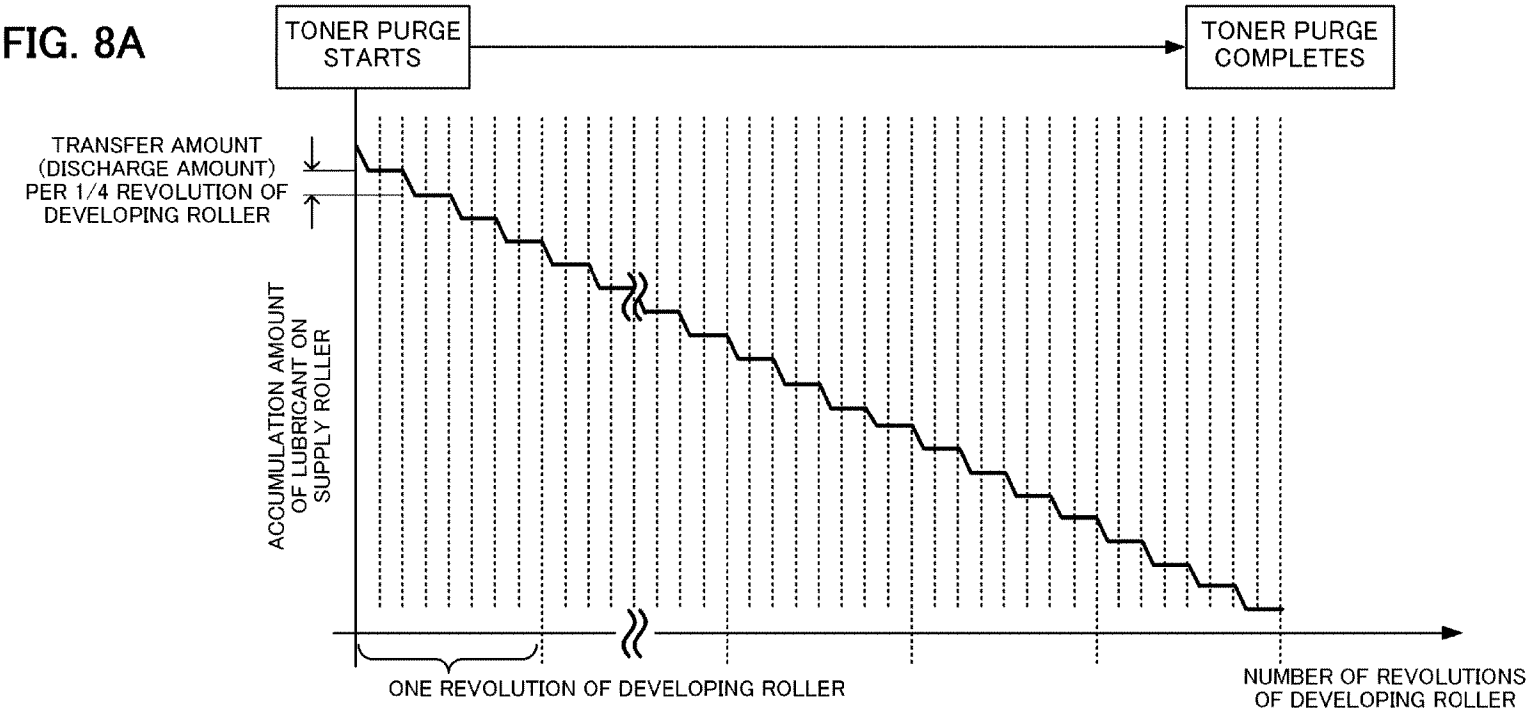
FIGS. 8A and 8B are schematic explanatory diagrams of a toner purge process of an initial installation sequence according to Embodiment 1.
Figure 8B:
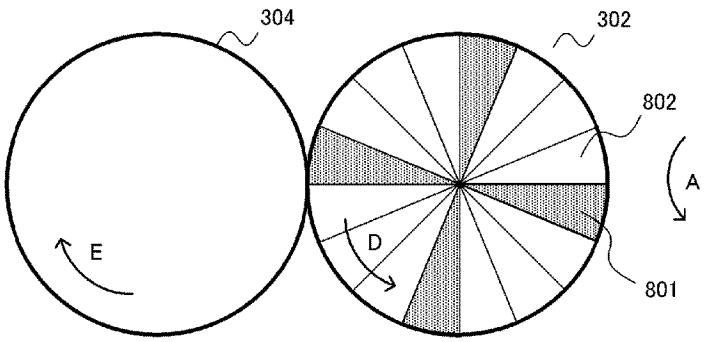

FIG. 8A illustrates change over time in the amount of the lubricant 401 remaining on the supply roller 304 during the toner purge process (c) of the present embodiment. As described above, during the toner purge process (c), the accumulated lubricant 401 remaining on the supply roller 304 is discharged to the photosensitive drum 201 via the developing roller 302 together with the toner 305. As illustrated in FIG. 8B, in the toner purge process (c), in order to suppress the discharge amount of the lubricant 401 and the toner 305 per one discharge to 0.0188 mg/cm$^2$, the surface of developing roller 302 is divided into 16 parts, and discharge 801 and suspend 802 are performed intermittently. One discharge means discharge in one discharge segment 801. In the present embodiment, in order to achieve the above-mentioned discharge amount, discharge 801 corresponding to 1/16 revolution and suspend 802 corresponding to 3/16 revolution are performed alternately. In the present embodiment, the developing roller 302 is rotated by 43 revolutions to complete discharge of the lubricant 401 included in the supply roller 304.

Figure 1A:
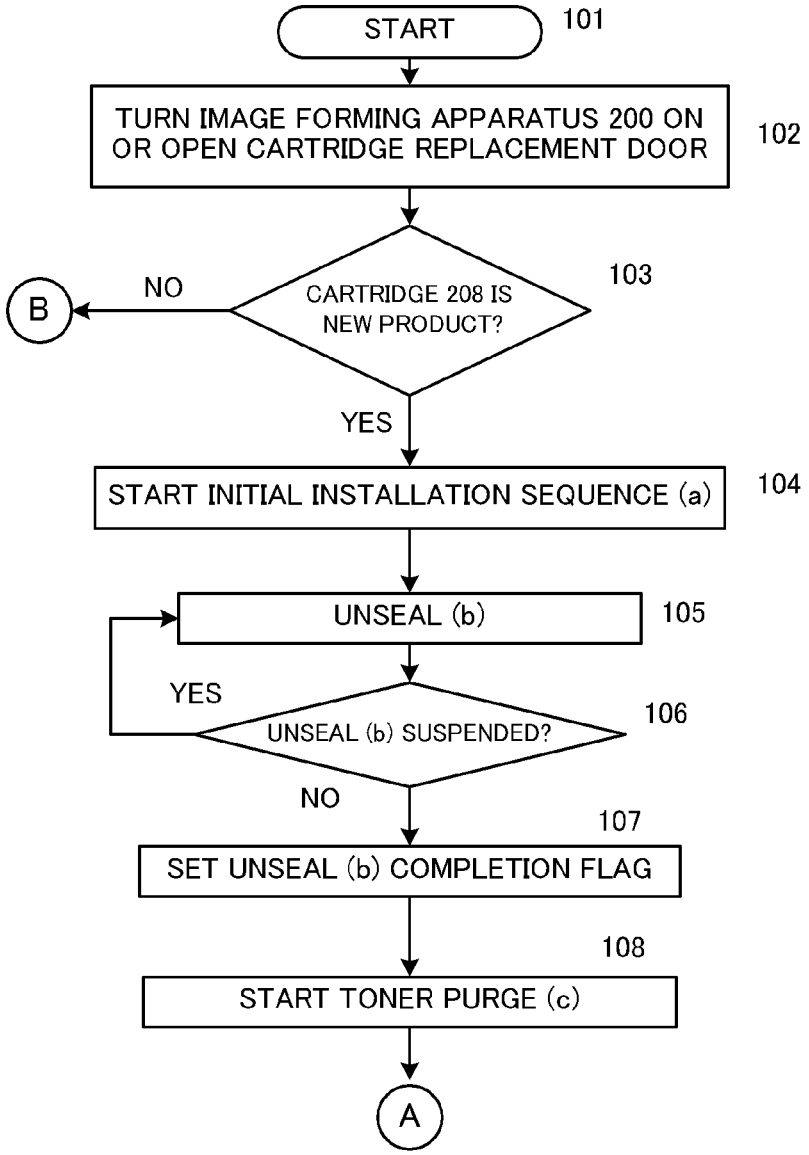
FIGS. 1A and 1B are a flowchart of an image forming apparatus according to Embodiment 1.
Figure 1B:
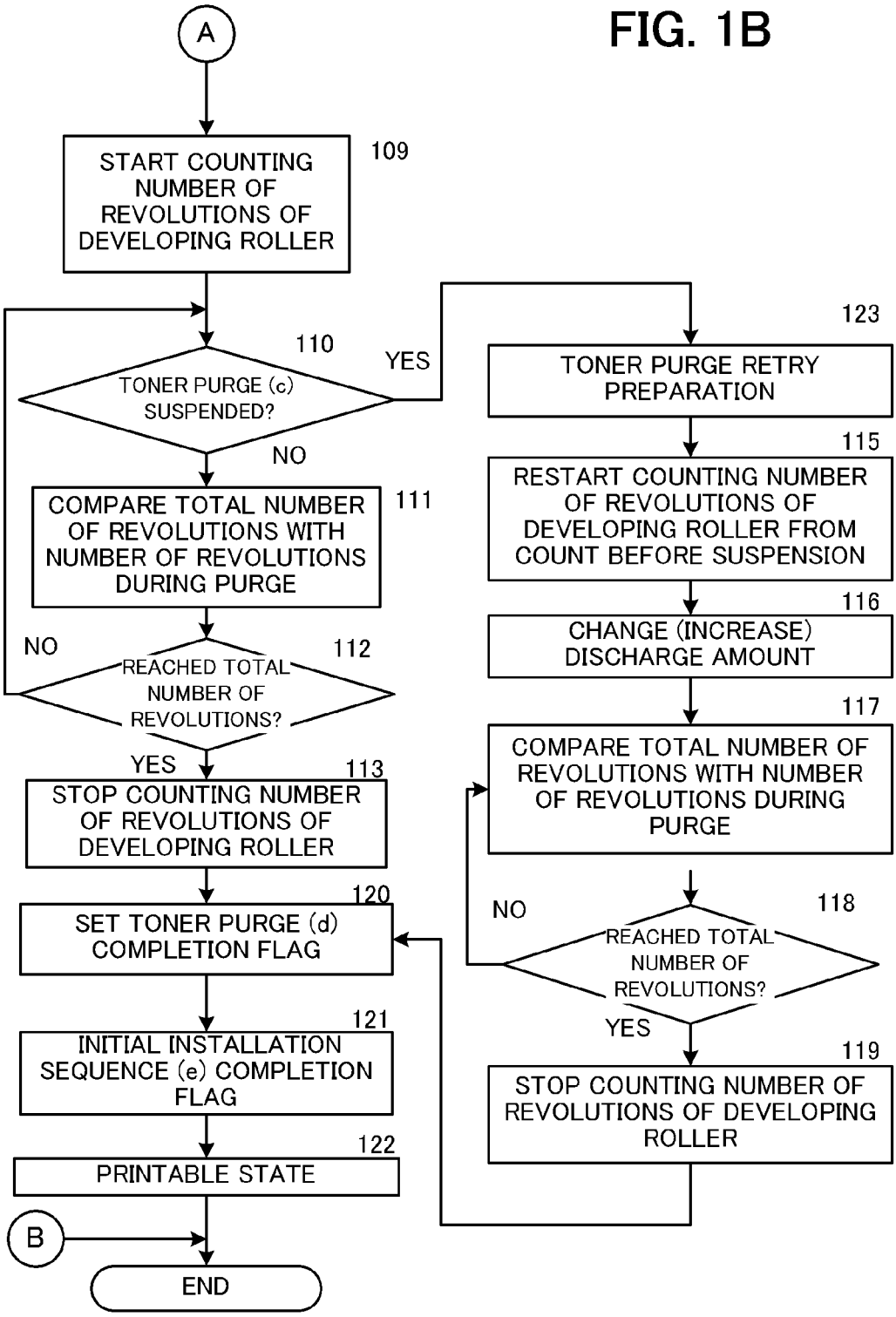

FIG. 1 illustrates the flowchart of an initial installation sequence of the image forming apparatus 200 according to the present embodiment. The flowchart illustrated in FIG. 1 takes suspension of the initial installation sequence into consideration. The description of the same operations as those of the flowchart of FIG. 7 will be omitted, and the difference will be mainly described.

As illustrated in FIG. 1, after the initial installation sequence starts, when the initial installation sequence is suspended due to opening or closing of the cartridge replacement door (not illustrated) during the unsealing operation (before unsealing) (b) (106: YES), the flow returns to the unsealing (b) again. Whether the seal is unsealed or not can be determined on the basis of whether the initial installation sequence has been continued for a predetermined period from the start.

When the toner purge process (c) starts (108), the CPU 214 starts counting the number of revolutions of the developing roller 302 during the toner purge process. A total number of revolutions of the developing roller 302 that has to rotate during the toner purge process is stored in advance in the data storage portion in the engine controller 215. The CPU 214 compares a total number of revolutions with the number of revolutions during the toner purge process (111). When the number of revolutions of the developing roller 302 reaches the total number of revolutions (112: YES), the CPU 214 ends the toner purge process. Specifically, the CPU 214 stops counting the number of revolutions of the developing roller 302 (113), sets a toner purge end flag in the data storage portion in the engine controller 215 (120), and sets an initial installation sequence completion flag (121). The above-described processes correspond to the initial installation sequence (the first initial operation) when suspension is not present. After these processes are performed, the image forming apparatus 200 enters into a printable state (122).

When the initial installation sequence is suspended due to opening/closing of the cartridge replacement door during the toner purge process (c) (110: YES), the image forming apparatus 200 executes another sequence (a second initial operation) different from a normal initial installation sequence. In this sequence, first, a toner purge retry preparation operation (123) is performed. In this retry preparation operation, the respective rollers rotate without discharging toner to the photosensitive drum 201. When the retry preparation is completed, the CPU 214 starts a discharge process and restarts counting the number of revolutions of the developing roller 302 from the count before suspension (115). When restarting the counting, the amount of toner discharged from the developing roller 302 to the photosensitive drum 201 is increased (116). The CPU 214 compares the navigation target area of the developing roller 302 stored in the memory with the number of revolutions during the toner purge process (117) and continues the discharge process until the number of revolutions reaches the total number of revolutions. When the number of revolutions of the developing roller 302 reaches the total number of revolutions (118: YES), the CPU 214 ends the toner purge process.

Specifically, the CPU 214 stops counting the number of revolutions 119), sets the toner purge process end flag and the initial installation sequence completion flag (120 and 121), and the image forming apparatus 200 enters into a printable state (122).

When it is determined that the process cartridge 208 is a new product (103: NO), as described above in FIG. 7, the operation ends by immediately putting the image forming apparatus 200 into a printable state (122).

Figure 9A:
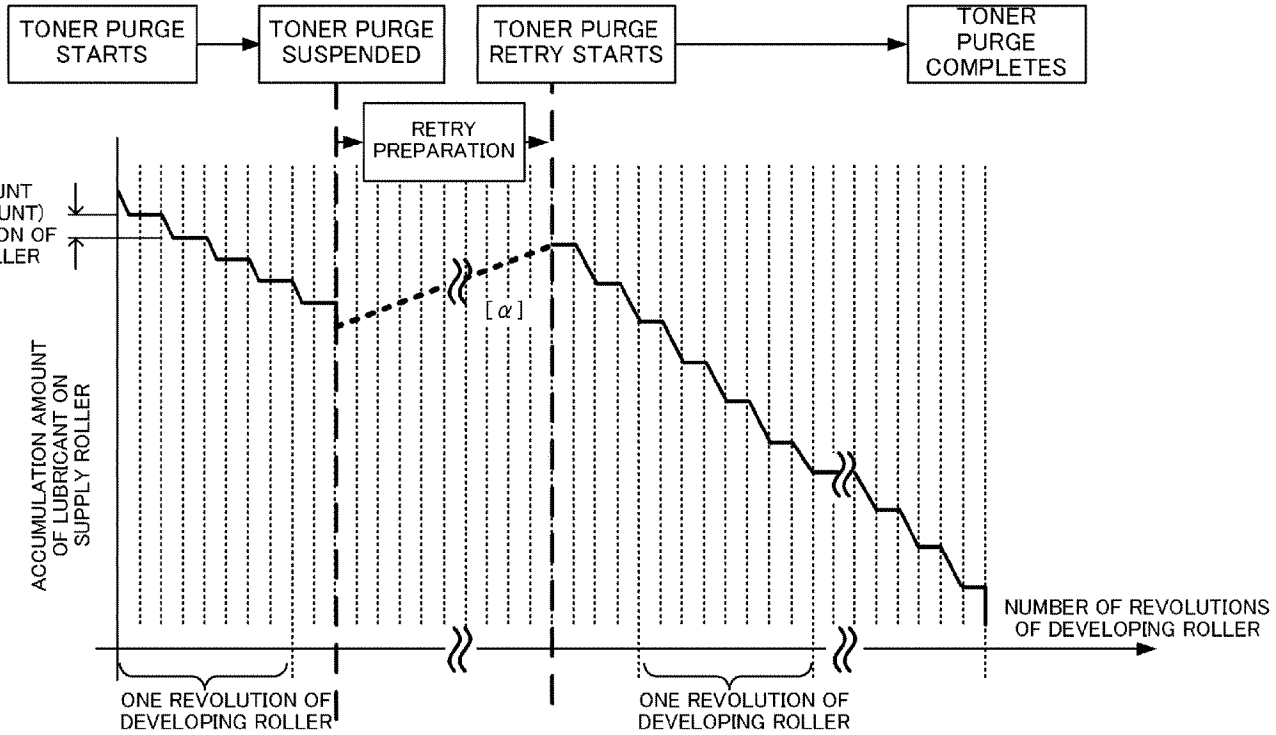
FIGS. 9A to 9C are schematic explanatory diagrams of a toner purge process when returning to the initial installation sequence according to Embodiment 1.

FIG. 9A illustrates change over time in the amount of the lubricant 401 accumulated in the supply roller 304 when a toner purge process is retried after the initial installation sequence is suspended. As illustrated in FIG. 9A, when the initial installation sequence is suspended during the toner purge process (c), the developing roller 302 rotates without toner being discharged to the photosensitive drum 201 at a retry preparation stage "α" until retry starts. Due to this, the amount of the accumulated lubricant 401 remaining on the supply roller 304 at the start time of retry is larger than that at the suspension time of the toner purge process. The reason why the developing roller 302 rotates after the suspension is as follows. (i) When the toner purge operation is suspended halfway, and particularly, the developing roller 302 abuts on the photosensitive drum 201, it is necessary to rotate the photosensitive drum 201 to collect and remove the toner discharged to the photosensitive drum 201 using the cleaning blade 206. (ii) For readjustment of the potential of the photosensitive drum 201 so as to perform a toner purge operation again, it is necessary to rotate the photosensitive drum 201 and the developing roller 302 in a forward direction so as to recharge the photosensitive drum 201 after the suspension. (iii) Even in a configuration in which the photosensitive drum 201 separates from the developing roller 302, it is necessary to rotate the photosensitive drum 201 and the developing roller 302 in a transition period from a suspension state to a separation state and a transition period from a separation state to an abutting state triggered by the resuming operation.

When the developing roller 302 rotates, the lubricant and the toner on the developing roller 302 are transferred to the supply roller 304 and the lubricant returns to the supply roller 304, whereby the amount of the lubricant accumulated on the supply roller 304 increases. When the supply roller 304 rotates together with the developing roller 302, the lubricant mixed in the toner stored in the developing chamber 306*a* returns to the supply roller 304 and is accumulated therein, whereby the amount of the lubricant accumulated on the supply roller 304 also increases.

Figure 9B:
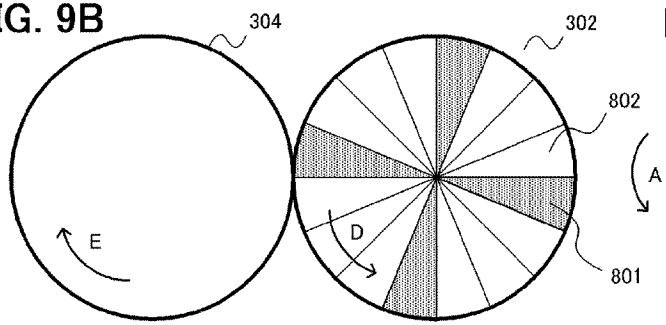
Figure 9C:
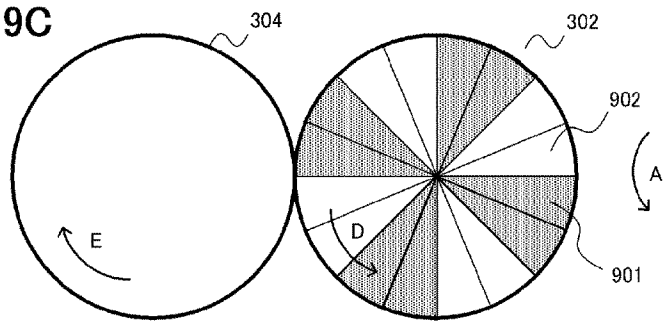

In the present embodiment, the total number of revolutions of the developing roller in the toner purge operation is not changed. In order to remove the entire lubricant 401 accumulated in the supply roller 304 by the remaining number of revolutions, it is necessary to increase the transfer amount (discharge amount) of the lubricant 401 and the toner 305 per revolution of the developing roller 302. Due to this, in the present embodiment, discharge (801) is performed in 16 divided parts in the initial installation sequence as illustrated in FIG. 9B, whereas discharge (901) is performed in eight divided parts during retry as illustrated in FIG. 9C. Specifically, discharge 901 corresponding to ⅛ revolution and suspend 802 corresponding to ⅛ revolution are performed alternately so that the discharge amount per revolution is doubled. In the present embodiment, it can be understood that the discharge amount per revolution of the developing roller 302 is increased. Moreover, it can be understood that the discharge amount per unit time from the start to the end of the resumed toner purge operation is increased. Furthermore, it can be understood that discharge and suspension are alternately performed in one rotation of the developing roller 302, and the proportion (time) of discharge in one rotation of the developing roller 302 during retry is increased. By increasing the discharge amount (time) in this manner, the lubricant 401 accumulated in the supply roller 304 can be sufficiently discharged to the photosensitive drum 201 via the developing roller 302.

As described above, as illustrated in FIG. 7, when only the lubricant 401 is present in the abutting edge portion 700 of the cleaning member 206, it is necessary to limit the amount of the toner 305 delivered to the abutting edge portion 700. However, when a cleaning layer of the toner 305 is formed in the abutting edge portion 700, it is not necessary to suppress the amount of the lubricant 401 and the toner 305 delivered at a time to 0.0188 mg/cm$^2$. Therefore, in the present embodiment, the discharge amount during a toner purge retry is set to 0.0376 mg/cm$^2$. In this manner, by increasing the discharge amount of toner from the developing roller 302, it is possible to remove the lubricant 401 remaining on the developing roller 302 and the supply roller 304 more reliably and to suppress streak images on an image in the latter half of the service life in which the toner charging performance deteriorates.

As described above, when the initial installation sequence is suspended, by performing another sequence different from the normal sequence and increasing the toner purge amount, it is possible to suppress streak images occurring on an image in the latter half of the service life in which the toner charging performance deteriorates and to improve the image quality.

In the present embodiment, in the initial installation sequence (the first initial operation), as illustrated in FIG. 9B, the developing roller 302 is divided into 16 parts and discharge 801 and suspend 802 are repeated. However, this can be changed appropriately. The discharge amount may be increased or decreased as long as the photosensitive drum 201 can be cleaned by the cleaning member 206 without causing slipping-through of the lubricant 401 and the toner 305.

In the present embodiment, the developing roller 302 is rotated by 43 revolutions to remove the lubricant 401. However, this can be changed appropriately. The number of revolutions of the developing roller 302 may be decreased or increased as long as the accumulated lubricant 402 remaining on the supply roller 304 can be discharged.

In the present embodiment, the progress state of the initial installation sequence is stored in the memory in the engine controller 215. However, the progress state may be managed arbitrarily in the image forming apparatus 200. For example, the progress state data may be stored in a nonvolatile memory (not illustrated) mounted in the process cartridge 208.

In the present embodiment, the discharge amount of the toner from the developing roller 302 to the photosensitive drum 201 in the other sequence (the second initial operation) after return when the toner purge operation is suspended is twice the normal discharge amount. However, this can be changed appropriately. The discharge amount may be larger or smaller than twice the normal discharge amount as long as the photosensitive drum 201 can be cleaned by the cleaning member 206 without causing slipping-through of the lubricant 401 and the toner 305 and the remaining lubricant 401 can be discharged sufficiently.

In the present embodiment, in the other sequence after return when the toner purge operation is suspended, the discharge amount is increased by changing the number of divisions (the proportion) of discharge and suspension of the developing roller 302. However, a method of increasing the discharge amount is not limited thereto. For example, a method of increasing the rotation speed of the developing roller 302 to improve the ability to supply toner to the photosensitive drum 201 may be employed. In this case, the rotation speed of the developing roller 302 may be increased also if the amount of toner supplied to the developing roller 302 by the toner supply roller 304 is insufficient. By doing so, it is possible to increase the transfer amount of toner from the developing roller 302 to the photosensitive drum 201 per unit time. Moreover, the image forming apparatus 200 may increase the rotation speed of both the developing roller 302 and the toner supply roller 304 by increasing the discharge amount per revolution of the developing roller 302 described in FIGS. 9A to 9C so that a total discharge amount is equal.

In the present embodiment, the number of revolutions of the developing roller 302 is used as information serving as the basis of determination of a suspension state of the toner purge operation (that is, a parameter indicating a progress state of the first initial operation or an execution amount of the first and second initial operations). However, the information is not limited thereto. For example, control may be performed on the basis of an execution time of the first and second initial operations. That is, an execution time of the second initial operation may be determined to be longer than a difference between a predetermined total execution time of the first initial operation and an execution time during suspension of the first initial operation (in this case, the execution time of the second initial operation may be shorter than the total execution time of the first initial operation).

The number of revolutions of another rotating member such as the photosensitive drum 201 rotating following the rotation of the developing roller other than the number of revolutions of the developing roller 302 may be used. Moreover, a remaining number of revolutions (a number of non-executed revolutions) of the number of revolutions scheduled for the first initial operation may be used instead of the integrated number of revolutions. Moreover, an execution time of a completed toner purge operation or an execution time of a remaining toner purge operation may be used as the execution time of the toner purge operation.

Various methods for resuming the toner purge operation may be used. For example, the process may be resumed intermittently from a suspension point. That is, an execution amount left after the suspension within a scheduled total execution amount of the first initial operation is continuously executed by the second initial operation. Alternatively, the process may be resumed from a point slightly before the suspension point. That is, an execution amount larger than the execution amount (an execution amount which could not be processed by the first initial operation) left after suspension may be executed by the second initial operation. With such control, when the suspended process is resumed, the downtime can be reduced as compared to when the toner purge operation is resumed from the beginning.

Embodiment 2

In Embodiment 1, the discharge amount per unit time of the lubricant 401 and the toner 305 is increased in the other sequence during return when the initial installation sequence is suspended. In contrast, in the present embodiment, the number of discharge times is increased in the other sequence during return. In this way, it is possible to increase the discharge amount of the lubricant remaining in the supply roller 304 in such an environment that a cleaning performance is poor.

Hereinafter, the present embodiment will be described. The description of the same portions as those of Embodiment 1 will be omitted.

The cleaning member 206 is formed of urethane rubber. When the urethane rubber is in an environment such as a low temperature at which the rubber hardens, the removal performance (the cleaning performance) of removing the lubricant 401 and the toner 305 from the photosensitive drum 201 decreases. When the removal performance decreases, the upper limit of the discharge amount per one discharge decreases. Due to this, in the present embodiment, the total discharge amount is changed by increasing the number of discharge times without changing the discharge amount at a time.

Figure 10A:
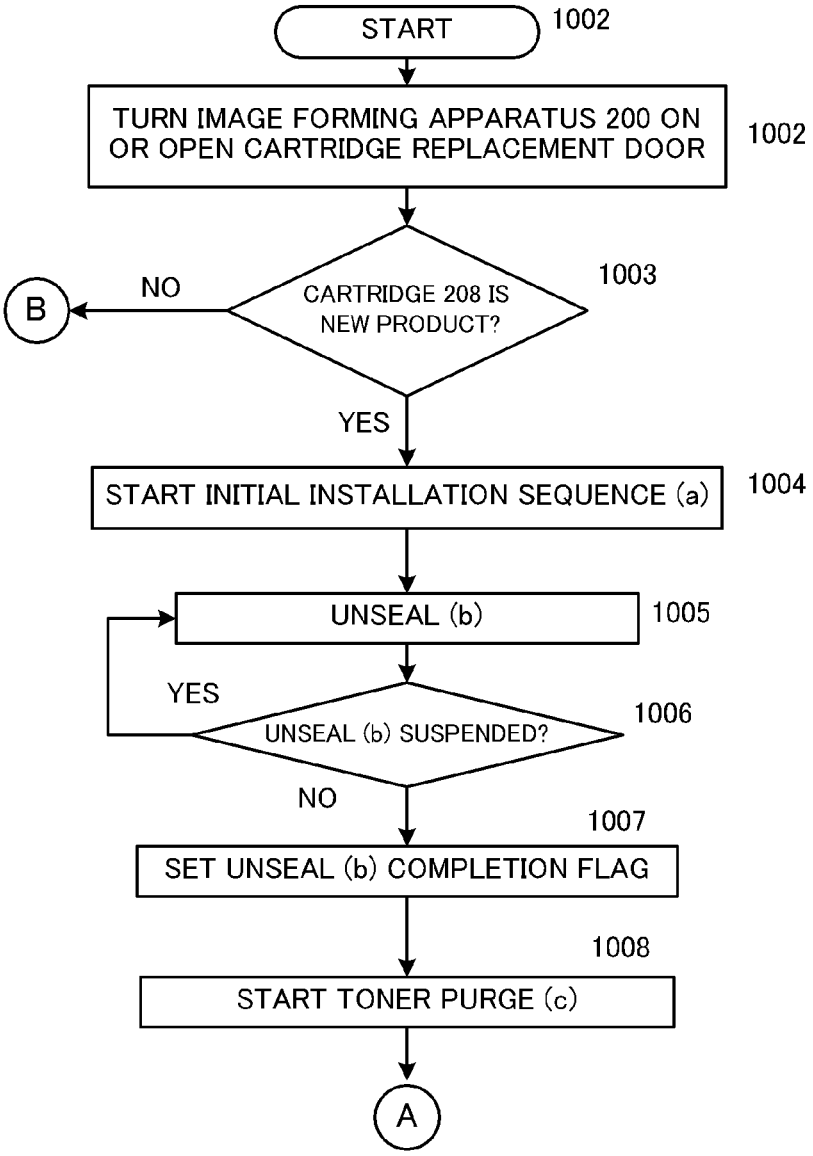
FIGS. 10A and 10B are a flowchart of an image forming apparatus according to Embodiment 2.
Figure 10B:
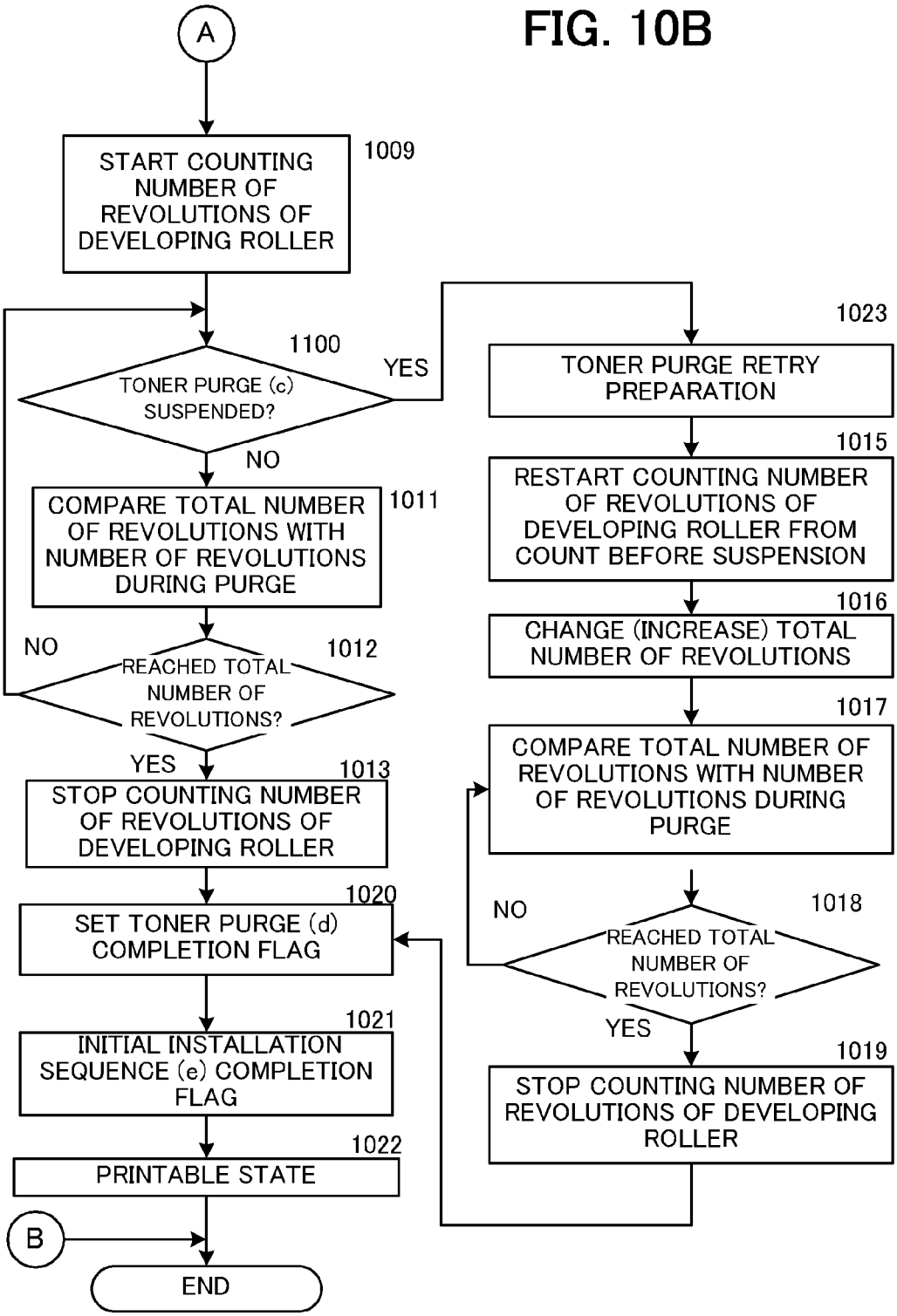

FIG. 10 illustrates the flowchart of an initial installation sequence of the image forming apparatus 200 according to the present embodiment. The process when suspension does not occur during the initial installation sequence is the same as that of Embodiment 1 (see FIG. 1). In the present embodiment, the process in the other sequence (the second initial operation) during return from suspension is different from that of Embodiment 1.

As illustrated in FIG. 10, when the initial installation sequence is suspended during the toner purge operation (c) (1010), the other sequence starts and the toner purge retry preparation operation (1023) is performed. When the retry preparation is completed, the CPU 214 starts a discharge process and restarts counting the number of revolutions of the developing roller 302 from the count before suspension (1015). When restarting the counting, the CPU 214 changes the value of the total number of revolutions of the developing roller 302 during the toner purge operation, stored in the memory to a value larger than the normal value. The CPU 214 continues the discharge process until the counted number of revolutions of the developing roller 302 reaches the total number of revolutions after change. When the number of revolutions of the developing roller 302 reaches the total number of revolutions after change (1018: YES), the CPU 214 ends the toner purge operation. Specifically, the CPU 214 stops counting the number of revolutions 1019), sets the toner purge process end flag and the initial installation sequence completion flag (1020 and 1021), and the image forming apparatus 200 enters into a printable state (1022).

Figure 11A:
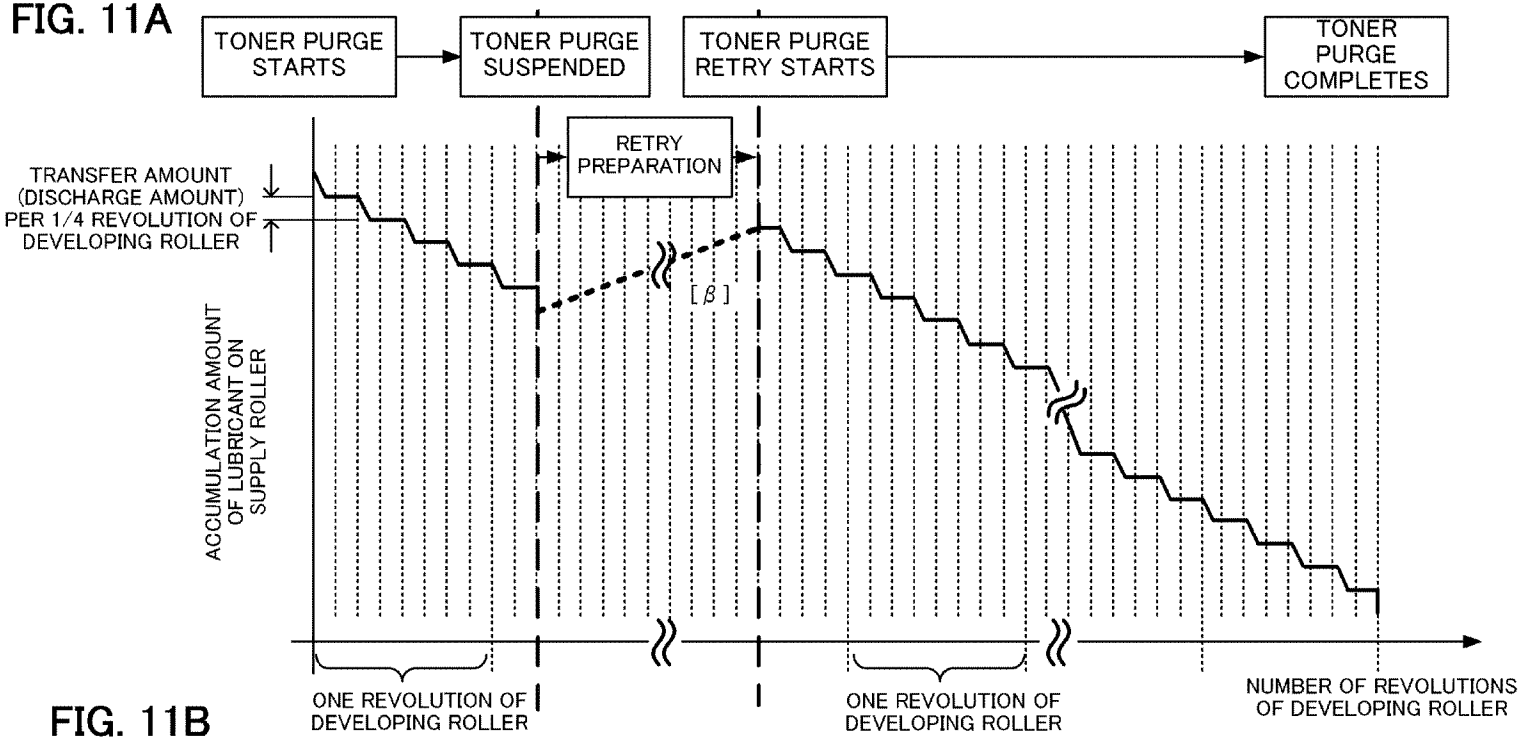
FIGS. 11A and 11B are schematic explanatory diagrams of a toner purge process when returning to the initial installation sequence according to Embodiment 2.
Figure 11B:
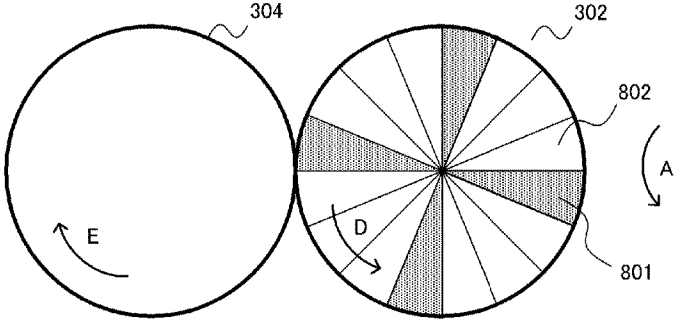

FIG. 11A illustrates change over time in the amount of the lubricant 401 accumulated in the supply roller 304 when a toner purge process is retried after the initial installation sequence is suspended. As illustrated in FIG. 11A, when the initial installation sequence is suspended during the toner purge process (c), the developing roller 302 rotates without toner being discharged to the photosensitive drum 201 at a retry preparation stage "β" until retry starts. Due to this, the amount of the accumulated lubricant 401 remaining on the supply roller 304 at the start time of retry is larger than that at the suspension time of the toner purge process. In the present embodiment, the discharge amount (a discharge amount per revolution of the developing roller 302) per revolution in the toner purge operation is not changed. That is, as illustrated in FIG. 11B, even when the toner purge retry operation starts, the number of divisions of the developing roller 302 is the same (16 divisions) as before suspension. In the present embodiment, the developing roller 302 is rotated twice the remaining number of revolutions during suspension (a value obtained by subtracting the counted number of revolutions during suspension from the target total number of revolutions). In this manner, by increasing the number of discharge times, it is possible to sufficiently remove the lubricant 401 in an environment in which the performance of the cleaning member 206 deteriorates and to suppress streak images occurring on an image in the latter half of the service life in which the toner charging performance deteriorates.

In the present embodiment, the number of revolutions of the developing roller 302 in the other sequence after return is twice the remaining number of revolutions. However, this may be changed appropriately. The number of revolutions may be increased arbitrarily as long as it is possible to remove the remaining lubricant 401. For example, the number of revolutions may be an integer multiple of the remaining number of revolutions other than twice. Rather than setting the number of revolutions to an integer multiple of the remaining number of revolutions, a number of revolutions which is an addition of a predetermined number and the remaining number of revolutions, a number of revolutions which is an addition of a predetermined number and an integer multiple of the remaining number of revolutions, and the like may be used. Moreover, how much the number of revolutions will be increased may be determined on the basis of the extent of deterioration in the cleaning performance of the cleaning member 206. Since the cleaning performance is mainly determined by a temperature, the increase in the number of revolutions may be determined on the basis of an environmental temperature. The environmental temperature may be acquired from a temperature sensor 222 by providing the same in the image forming apparatus 200.

In the present embodiment, the discharge amount per one discharge is changed. However, the discharge amount per one discharge may be changed as described above in Embodiment 1. That is, in a retried toner purge operation, in order to increase the total removal amount (corresponding to the total discharge amount) of the lubricant equivalent to those of FIGS. 9A to 9C and FIGS. 11A and 11B, the image forming apparatus 200 may change both the discharge amount per one discharge and the number of discharge times and execute a toner purge retry operation. In this case, the discharge amount may be increased or decreased.

In order to realize an equivalent total discharge amount, as described above in Embodiment 1, the rotation speed of the developing roller 302 may be increased also.

Embodiment 3

In the above description, a case in which the initial installation sequence is suspended after the toner purge operation starts has been described. However, the present invention is not limited thereto. The initial installation sequence may be suspended in a period before the toner purge operation starts after the initial sequence described in FIG. 5 starts.

In this case, a second total amount which is a total amount of the developer transferred to the photosensitive drum 201 in the second initial operation executed until the first initial operation is suspended and when the first initial operation restarts is larger than a first total amount which is a total amount of the developer transferred to the photosensitive drum 201 in the initial installation sequence where no suspension occurs. That is, in the initial installation sequence where no suspension occurs described in FIG. 7, the image forming apparatus 200 increases a total discharge amount of the developer by increasing the discharge amount per one discharge, the number of discharge times, and the rotation speed of the developing roller 302 in an arbitrary combination. In this way, the lubricant is removed sufficiently, and developing unevenness (streak image) occurring due to the lubricant can be suppressed.

Embodiment 4

The discharge amount per one discharge is increased in the return sequence in Embodiment 1, and the number of discharge times is increased in the return sequence in Embodiment 2. In the present embodiment, whether the discharge amount per one discharge will be increased or the number of discharge times will be increased is determined on the basis of an environmental temperature. Specifically, the image forming apparatus 200 stores a temperature threshold at which the performance of the cleaning member 206 deteriorates in a memory, and the CPU 214 reads information stored in the memory when returning from suspension. Upon reading the information, the CPU 214 performs a return sequence of increasing the number of discharge times when the environmental temperature acquired by the temperature sensor 222 when returning from suspension is lower than the temperature threshold (Embodiment 2). On the other hand, the CPU 214 performs a return sequence of increasing the discharge amount per one discharge when the environmental temperature acquired by the temperature sensor 222 when returning from suspension is equal to or higher than the temperature threshold (Embodiment 1).

According to the present embodiment, it is possible to remove the lubricant reliably even when the performance of the cleaning member 206 deteriorates and to complete removal of the lubricant quickly when the performance of the cleaning member 206 is not deteriorated.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190464, filed on Sep. 29, 2017, which is hereby incorporated by reference herein in its entirety.

What is claimed is:

1. An image forming apparatus comprising:

an image bearing member on which an electrostatic latent image is formable; and a developing device including (1) a developer carrying member for carrying a developer and developing the electrostatic latent image, (2) a container storing the developer, and (3) a supply roller supplying the developer to the developer carrying member, wherein when the developing device including the developer carrying member, to which a lubricant different from the developer is applied, is used for the first time, a first initial operation of transferring the lubricant from the developer carrying member to the image bearing member together with the developer is performed, and wherein the image forming apparatus further comprises:

a storage unit configured to store a suspension state when suspension is detected before the first initial operation is completed; and a controller configured to execute a second initial operation as an operation of resuming the suspended first initial operation on the basis of the stored suspension state.

2. The image forming apparatus according to claim 1, wherein a second total amount, which is a total amount of the developer transferred to the image bearing member during the suspended first initial operation and the second initial operation, is larger than a first total amount which is a total amount of the developer transferred to the image bearing member during the completed first initial operation.

3. The image forming apparatus according to claim 1, wherein the developing device further includes a sealing member configured to seal an opening of the container, and wherein the controller is configured to perform (1) starting transferring of the lubricant and the developer after the sealing member is open in the first initial operation and (2) executing the second initial operation when the first initial operation is suspended after the transferring starts.

4. The image forming apparatus according to claim 1, wherein the controller is configured to increase an amount of the developer transferred to the image bearing member per revolution of the developer carrying member in the second initial operation to be larger than that during the first initial operation.

5. The image forming apparatus according to claim 4, wherein the controller is configured to (1) alternately perform (1a) transferring of the developer to the image bearing member and (1b) suspension of the transferring in the first and second initial operations and to (2) increase a proportion of the transferring within one revolution of the developer carrying member in the second initial operation to be larger than that during the first initial operation.

6. The image forming apparatus according to claim 1, wherein the controller is configured to increase an amount of the developer transferred to the image bearing member per unit time in a period from the start to the completion of the second initial operation to be larger than that during the first initial operation.

7. The image forming apparatus according to claim 1, wherein the controller is configured to increase a rotation speed of the developer carrying member in the second initial operation to be faster than that during the first initial operation.

8. The image forming apparatus according to claim 1, wherein the controller is configured to perform (1) identifying a parameter indicating a progress state of the first initial operation and (2) determining an execution amount of the second initial operation on the basis of a difference between a predetermined parameter value and a parameter value during suspension of the first initial operation.

9. The image forming apparatus according to claim 8, wherein the controller is configured to determine the execution amount of the second initial operation as an amount larger than a difference between a predetermined total execution amount of the first initial operation and an execution amount at suspension of the first initial operation.

10. The image forming apparatus according to claim 1, further comprising a cleaning member configured to abut on the image bearing member and to remove the developer transferred to the image bearing member, wherein a circumferential speed of the image bearing member during the first and second initial operations is lower than a circumferential speed during printing.

11. The image forming apparatus according to claim 1, further comprising a cleaning member configured to abut on the image bearing member and to remove the developer transferred to the image bearing member, wherein a third initial operation performed before printing starts when a lubricant different from the developer is applied to the developer carrying member and the developing device is used for the first time, wherein the image bearing member and the developer carrying member are rotated before the developer is carried on the developer carrying member to transfer the lubricant from the developer carrying member to the image bearing member, and wherein the image bearing member is rotated at a circumferential speed slower than that during printing so that the lubricant transferred to the image bearing member is removed from the image bearing member by the cleaning member.

12. The image forming apparatus according to claim 1, wherein in the second initial operation, the controller determines whether (1) an amount of the lubricant and the developer transferred to the image bearing member per unit time or per revolution of the developer carrying member is to be increased larger than that during the first initial operation or (2) a period in which the lubricant and the developer are transferred to the image bearing member is to be increased longer than that during the first initial operation on the basis of an environment temperature.

* * * * *